US010500606B2

(12) United States Patent
Ikagawa

(10) Patent No.: US 10,500,606 B2
(45) Date of Patent: Dec. 10, 2019

(54) EJECTION DEVICE

(71) Applicant: TAZMO CO., LTD., Okayama (JP)

(72) Inventor: Yoshinori Ikagawa, Okayama (JP)

(73) Assignee: TAZMO CO., LTD., Okayama (JP)

( * ) Notice: Subject to any disclaimer, the term of this patent is extended or adjusted under 35 U.S.C. 154(b) by 0 days.

(21) Appl. No.: 15/756,705

(22) PCT Filed: Sep. 1, 2016

(86) PCT No.: PCT/JP2016/075614
§ 371 (c)(1),
(2) Date: Mar. 1, 2018

(87) PCT Pub. No.: WO2017/038924
PCT Pub. Date: Mar. 9, 2017

(65) Prior Publication Data

US 2018/0250699 A1 Sep. 6, 2018

(30) Foreign Application Priority Data

Sep. 2, 2015 (JP) ..... 2015-172908

(51) Int. Cl.
*B05C 5/02* (2006.01)
*B05C 11/10* (2006.01)
(Continued)

(52) U.S. Cl.
CPC ..... *B05C 5/0258* (2013.01); *B05B 9/0409* (2013.01); *B05C 5/001* (2013.01);
(Continued)

(58) Field of Classification Search
None
See application file for complete search history.

(56) References Cited

U.S. PATENT DOCUMENTS 3,578,174 A * 5/1971 Karpacheva ..... F04B 15/04 210/416.1
3,815,822 A * 6/1974 Davies ..... A24C 5/24 118/603

(Continued)

FOREIGN PATENT DOCUMENTS

JP S55-054686 4/1980
JP S62-001512 A 1/1987

(Continued)

OTHER PUBLICATIONS

International Search Report for corresponding App. No. PCT/JP2016/075614, dated Nov. 22, 2016.

*Primary Examiner* — Jethro M. Pence
(74) *Attorney, Agent, or Firm* — Renner, Otto, Boisselle & Sklar, LLP

(57) ABSTRACT

An ejection device includes a nozzle that ejects an ejection fluid, an ejection-side pump, a driving-side pump, and a heating unit. The ejection-side pump includes a pressure transmitting member, and an ejection chamber and a driving chamber adjacent to each other across the pressure transmitting member. The ejection chamber is filled with the ejection fluid. The driving chamber is filled with a driving fluid. The driving-side pump is a pump that applies pressure to the driving fluid. The pressure transmitting member transmits the pressure applied to the driving fluid to the ejection fluid in the ejection chamber. The heating unit heats at least the ejection-side pump while the driving-side pump remains unheated.

15 Claims, 7 Drawing Sheets

(51) Int. Cl.

| | |
|---|---|
| ***F04B 9/103*** | (2006.01) |
| ***B05B 9/04*** | (2006.01) |
| ***B05C 5/00*** | (2006.01) |
| ***F04B 43/067*** | (2006.01) |
| ***F04B 9/08*** | (2006.01) |
| ***F04B 9/10*** | (2006.01) |

(52) U.S. Cl.

CPC ..... *B05C 5/02* (2013.01); *B05C 5/0254* (2013.01); *B05C 11/10* (2013.01); *B05C 11/1002* (2013.01); *B05C 11/1026* (2013.01); *B05C 11/1042* (2013.01); *F04B 9/08* (2013.01); *F04B 9/10* (2013.01); *F04B 9/103* (2013.01); *F04B 43/067* (2013.01)

(56) References Cited

U.S. PATENT DOCUMENTS

| | | | | |
|---|---|---|---|---|
| 5,046,666 | A * | 9/1991 | Ono | B05C 5/02 239/119 |
| 2002/0071772 | A1 | 6/2002 | Isogai | |

FOREIGN PATENT DOCUMENTS

| | | | | |
|---|---|---|---|---|
| JP | H02-021960 | | 5/1990 | |
| JP | H6-017757 | A | 1/1994 | |
| JP | H0617757 | B2 * | 3/1994 | F02M 37/06 |
| JP | H7-024369 | A | 1/1995 | |
| JP | H7-174075 | A | 7/1995 | |
| JP | H10-308347 | A | 11/1998 | |
| JP | 2924466 | B2 | 5/1999 | |
| JP | 2002-239433 | | 8/2002 | |
| JP | 2002-338110 | | 11/2002 | |
| JP | 2005-052717 | A | 3/2005 | |
| JP | 2009-072690 | A | 4/2009 | |
| JP | 2009-082791 | | 4/2009 | |
| JP | 2012-220410 | | 11/2012 | |
| JP | 2013-006177 | | 1/2013 | |
| JP | 2014-172031 | | 9/2014 | |
| JP | 2014-184405 | A | 10/2014 | |
| KR | 10-2004-0081336 | A | 9/2004 | |
| KR | 10-2007-012245 | A | 1/2007 | |

* cited by examiner

EJECTION DEVICE

TECHNICAL FIELD

The present invention relates to an ejection device that ejects a fluid from a nozzle by the operation of a pump.

BACKGROUND ART

An example of an ejection device that ejects a fluid from a nozzle is a coating device. In the coating device, a coating liquid is ejected generally by using a pump (see patent literature 1, for example). More specifically, the pump is connected to a slit nozzle and a coating liquid tank. By the operation of the pump, the coating liquid in the coating liquid tank is supplied through the pump to the slit nozzle and ejected from the slit nozzle.

In some cases, such a coating device includes a heating unit that heats the coating liquid to be ejected. The heating unit heats the coating liquid before being ejected by mainly heating the nozzle.

CITATION LIST

Patent Literature

Patent literature 1: Japanese published examined patent application No. 2014-184405

SUMMARY OF INVENTION

Technical Problem

In the coating device with the heating unit, an effort has been required to be made for providing heat resistance to the pump. For example, a driving source (a motor having an electrical structure) for applying driving force to the pump has been required to be covered with a heat shield, for example. A probable effort is to incorporate a heat-resisting component into a structure of the pump or provide the pump with a cooling mechanism. However, both of these efforts have caused cost increase and have involved complex configurations.

It is therefor an object of the present invention to provide an ejection device capable of heating a fluid to be ejected and capable of providing heat resistance to a pump with a minimum required effort.

Solution to Problem

An ejection device according to the present invention includes a nozzle that ejects an ejection fluid, an ejection-side pump, a driving-side pump, and a heating unit. The ejection-side pump includes a pressure transmitting member, and an ejection chamber and a driving chamber adjacent to each other across the pressure transmitting member. The ejection chamber is filled with the ejection fluid. The driving chamber is filled with a driving fluid. The driving-side pump is a pump that applies pressure to the driving fluid. The pressure transmitting member transmits the pressure applied to the driving fluid to the ejection fluid in the ejection chamber. The heating unit heats at least the ejection-side pump while the driving-side pump remains unheated.

Advantageous Effects of Invention

The ejection device according to the present invention is capable of heating a fluid to be ejected and capable of providing heat resistance to a pump with a minimum required effort.

DESCRIPTION OF EMBODIMENTS

Figure 1:
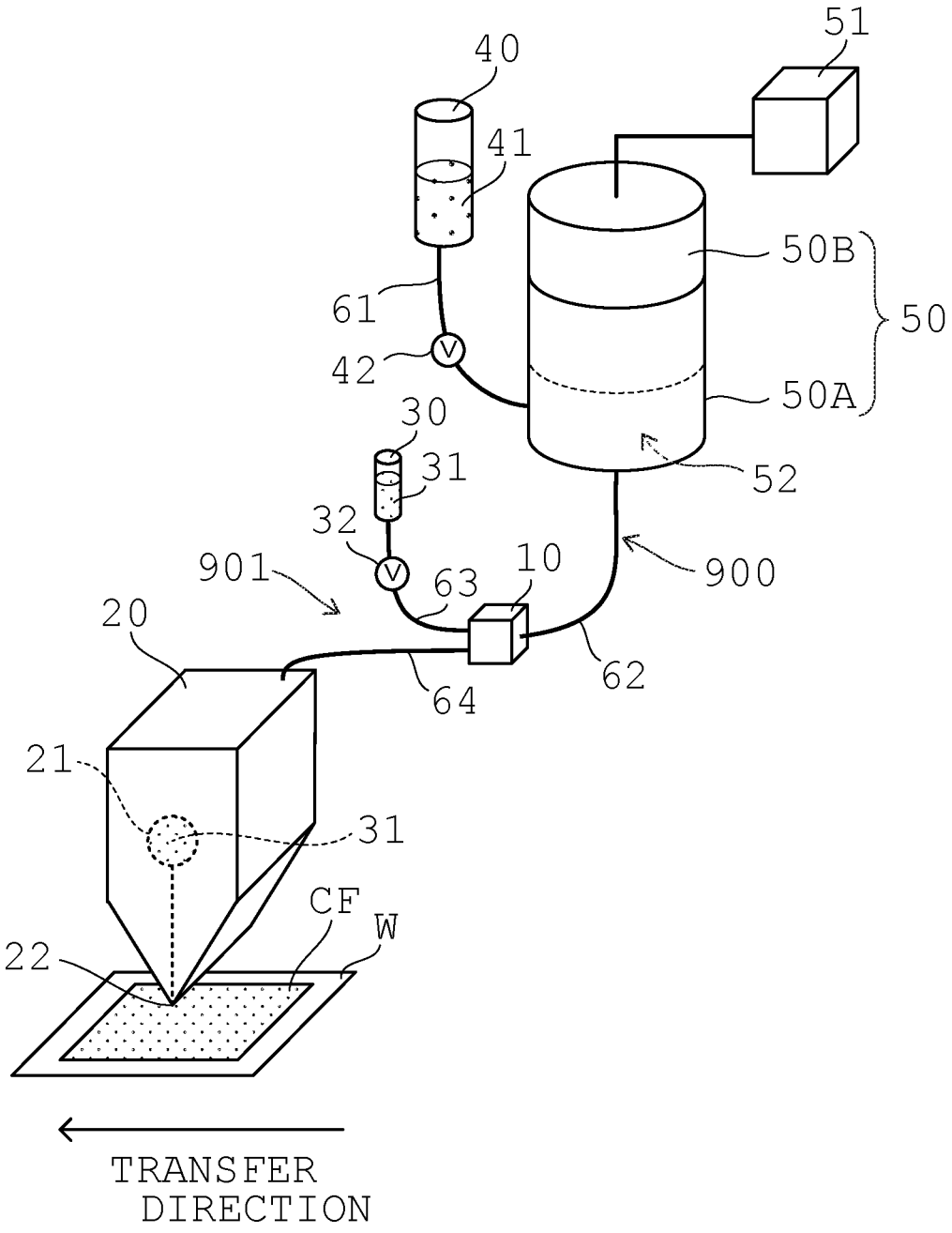
FIG. 1 is a conceptual view of a coating device according to a first embodiment.

Embodiments of application of the present invention to a coating device will be described in detail below by referring to the drawings.

[1] First Embodiment

[1-1] Configuration of Coating Device

The configuration of a coating device without a heating unit will be described first as a first embodiment. An embodiment of a coating device with a heating unit will be described as a third embodiment and a subsequent embodiment. As shown in FIG. 1, the coating device includes a slit nozzle 20, a master pump 50 (corresponding to a "driving-side pump" in Claims), a storage tank 40, a slave pump 10 (corresponding to an "ejection-side pump" in Claims), and a storage tank 30.

The slit nozzle 20 includes a storage part 21 storing a coating liquid 31 (corresponding to an "ejection fluid" in Claims), and a slit 22 provided at the lower tip of the slit nozzle 20 and to which the coating liquid 31 is supplied from the storage part 21. The slit nozzle 20 is arranged in such a manner that the longitudinal direction of the slit 22 is perpendicular to a transfer direction for a workpiece W in a horizontal plane. The slit nozzle 20 ejects the coating liquid 31 from the slit 22 onto a main surface of the workpiece W being transferred in the transfer direction to form a coating film CF. Alternatively, the slit nozzle 20 may move in a direction perpendicular to the longitudinal direction of the slit 22 in the horizontal plane to transfer the workpiece W relative to the slit nozzle 20.

The master pump 50 is a syringe pump to be operated by driving force applied from a motor 51. More specifically, the master pump 50 is made up of a syringe 50A and a plunger 50B to be driven by the motor 51. An ejection chamber 52 capable of being pressurized by the plunger 50B is formed inside the syringe 50A. The ejection chamber 52 communicates with the storage tank 40 through a connection tube 61 and communicates with the slave pump 10 through a connection tube 62. The connection tubes 61 and 62 are connection members, and they are resin tubes having flexibility. The storage tank 40 stores water 41 and is pressurized to predetermined pressure. An openable and closable air-actuated valve 42 is provided in a flow path in the connection tube 61. As a result, the ejection chamber 52 in the master pump 50 and the slave pump 10 (more specifically, a driving chamber 11 described later) are connected through the connection tube 62 to form a driving-side flow path 900. The connection tubes 61 and 62 are not always resin tubes having flexibility but may be various types of connection members such as pipes having substantially no flexibility.

Figure 2A:
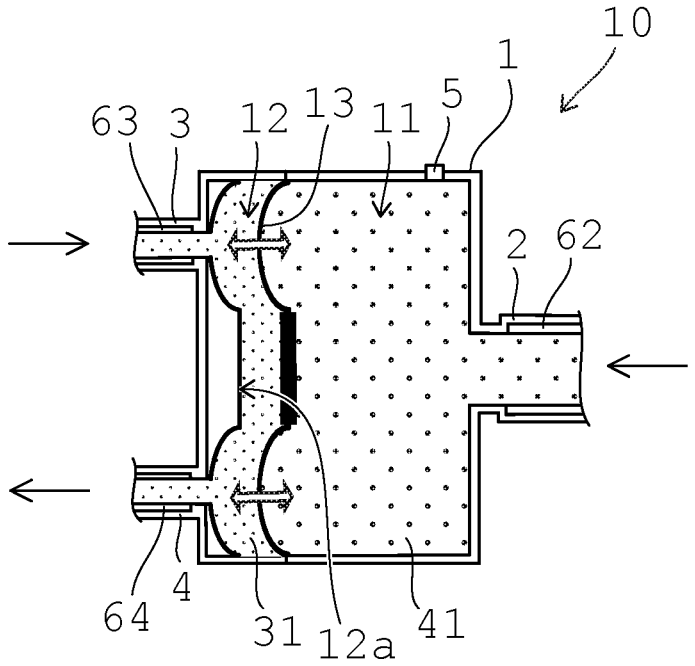
FIG. 2A is a sectional view schematically showing the internal configuration of a slave pump in the coating device.

In this embodiment, the driving-side flow path 900 extends from the ejection chamber 52 in the master pump 50 to the driving chamber 11 in the slave pump 10 (see FIG. 2A). The driving-side flow path 900 is filled with the water 41 functioning as a driving fluid for transmitting pressure. As long as the driving-side flow path 900 can continuously be filled with the water 41, the storage tank 40 is omissible.

The master pump 50 is not limited to a syringe pump but various types of pumps are applicable as the master pump 50 such as a diaphragm pump and a screw pump capable of applying pressure (positive pressure) to the water 41 (driving fluid) in the ejection chamber 52. For example, the master pump 50 may be a pump originally provided in the coating device.

The slave pump 10 is connected to the storage tank 30 through a connection tube 63 and connected to the storage part 21 in the slit nozzle 20 through a connection tube 64. The storage tank 30 stores the coating liquid 31 and is pressurized to predetermined pressure. An openable and closable air-actuated valve 32 is provided in a flow path in the connection tube 63.

As shown in FIG. 2A, the slave pump 10 includes a case 1, and a diaphragm 13 (corresponding to a "pressure transmitting member" in Clams) provided in the case 1. The interior of the case 1 is partitioned by the diaphragm 13 to form the driving chamber 11 and the ejection chamber 12 in the case 1 separated from each other by the diaphragm 13. The slave pump 10 is not limited to including the diaphragm 13 but may include any one of pressure transmitting members capable of transmitting pressure from the driving chamber 11 to the ejection chamber 12. As an example, the slave pump 10 may include a cylinder movable between the driving chamber 11 and the ejection chamber 12 as the pressure transmitting member instead of the diaphragm 13.

The case 1 is provided with three connection ports 2 to 4, and an air outlet 5. The connection port 2 communicates with the driving chamber 11, and one end of the connection tube 62 is connected to the connection port 2. Both the connection ports 3 and 4 communicate with the ejection chamber 12. One end of the connection tube 63 is connected to the connection port 3, and one end of the connection tube 64 is connected to the connection port 4. The connection tubes 63 and 64 are connection members, and they are resin tubes having flexibility. The connection tubes 63 and 64 are not always resin tubes having flexibility but may be various types of connection members such as pipes having substantially no flexibility.

As a result of the foregoing connections through the connection tubes 62 to 64, the driving chamber 11 communicates with the ejection chamber 52 in the master pump 50 through the connection port 2 and the connection tube 62. The ejection chamber 12 communicates with the storage tank 30 through the connection port 3 and the connection tube 63. The ejection chamber 12 also communicates with the storage part 21 in the slit nozzle 20 through the connection port 4 and the connection tube 64. As a result, the storage tank 30 is connected to the storage part 21 through the connection tube 63, the ejection chamber 12, and the connection tube 64 in this order, thereby forming an ejection-side flow path 901. The ejection-side flow path 901 is filled with the coating liquid 31 as the ejection fluid.

In the foregoing configuration of the coating device, the ejection chamber 12 in the slave pump 10 has a smaller capacity than the ejection chamber 52 in the master pump 50. In this embodiment, as shown in FIG. 2A, the ejection chamber 12 has an inner surface 12*a* facing the diaphragm 13 and having a shape matching the shape of the diaphragm 13. The inner surface 12*a* is formed so as to be spaced by a uniform clearance from the diaphragm 13. As an example, the clearance is equal to the inner diameter of the connection tube 63 or 64. As another example, the clearance is equal to a range of displacement of the diaphragm 13. As a result of this shape of the inner surface 12*a* of the ejection chamber 12, the capacity of the ejection chamber 12 can easily be smaller than that of the ejection chamber 52 in the master pump 50.

To restrict the amount of the coating liquid 31 required for filling the ejection-side flow path 901 entirely with the coating liquid 31 so as to allow ejection of the coating liquid 31 from the slit 22, the connection tubes 63 and 64 are set at lengths that minimizes the length of the ejection-side flow path 901 and at small inner diameters. By doing so, the capacity of the ejection-side flow path 901 becomes smaller than that of the driving-side flow path 900.

Before starting process of coating with the coating liquid 31, the coating device opens the air-actuated valves 32 and 42 for a predetermined period of time by controlling supply of air to the air-actuated valves 32 and 42. By doing so, the driving-side flow path 900 is filled with the water 41 and the ejection-side flow path 901 is filled with the coating liquid 31. Then, the air-actuated valve 42 is closed to hermetically close the driving-side flow path 900. The air-actuated valve 32 is also closed. Even if air is mixed into the driving-side flow path 900, the mixed air is discharged through the air outlet 5 in the slave pump 10.

If the plunger 50B moves to reduce the capacity of the ejection chamber 52 in the master pump 50, pressure (positive pressure) is applied to the water 41 (driving fluid) in the ejection chamber 52. As a result, the pressure is transmitted to the slave pump 10 through the water 41 in the driving-side flow path 900. Then, the slave pump 10 transmits the pressure having been transmitted through the water 41 further to the coating liquid 31 in the ejection chamber 12 through the diaphragm 13. More specifically, as the capacity of the ejection chamber 52 in the master pump 50 changes, the diaphragm 13 closer to the driving chamber 11 is displaced to be closer to the ejection chamber 12, thereby transmitting the pressure to the ejection chamber 12. In this way, the pressure (positive pressure) is applied to the coating liquid 31 in the ejection-side flow path 901 to eject the coating liquid 31 from the slit 22. After the coating liquid 31 is ejected, the diaphragm 13 is displaced to be closer to the driving chamber 11.

After the foregoing series of coating operations is finished, the coating device performs a recharging operation. The recharging operation is for returning the plunger 50B to a position in the master pump 50 where the plunger 50B was disposed before the coating operations are started, in order to generate again the movement of the diaphragm 13 required for the coating. The coating device repeats the foregoing coating operations and the recharging operation alternately to eject the coating liquid 31 from the slit 22 of the slit nozzle 20 repeatedly.

In the coating device of this embodiment, the capacity of the ejection chamber 12 in the slave pump 10 is smaller than that of the ejection chamber 52 in the master pump 50. Thus, only a small amount of the coating liquid 31 is sufficient for filling the ejection chamber 12, making it possible to restrict the amount of the coating liquid 31 required for implementation of the coating operations. As a result, the efficiency of use of the coating liquid 31 is increased. The amount of the coating liquid 31 not to be ejected but to be used only for implementation of the coating operations can be restricted, particularly if a small amount of the coating liquid 31 is to be used for coating in a case where a liquid used as the coating liquid 31 is relatively costly or where the coating liquid 31 is used for experimental purpose, for example. Thus, even if the coating liquid 31 in the ejection-side flow path 901 is disposed of without being reused when exchanged, for example, the amount of the waste coating liquid 31 is restricted.

Examples of effect achieved by the coating device are described in detail. Consideration is first given to a configuration according to the conventional technique using only a master pump with an ejection chamber having a relatively large capacity. In this configuration, it is assumed that the amount of a coating liquid required for filling a flow path from the master pump to a slit nozzle is 100 cc and the amount of the coating liquid to be ejected from the slit nozzle is 0.1 cc. In this case, to allow implementation of the coating operations, the amount of the coating liquid to be prepared is 1000 times (100/0.1) larger than the amount to actually be ejected.

By contrast, in the coating device of this embodiment, the amount of the coating liquid 31 required for filling the ejection-side flow path 901 can be restricted to about 5 cc, for example, by reducing the capacity of the ejection chamber 12 in the slave pump 10. Thus, the amount of the coating liquid 31 required for implementation of the coating operations can only be about 50 times (5/0.1) larger than the amount of the coating liquid 31 to actually be ejected (0.1 cc). In this way, the coating device of this embodiment achieves increase in the efficiency of use of the coating liquid 31.

In the coating device of this embodiment, pressure applied from the master pump 50 to the water 41 (driving fluid) is transmitted through the driving-side flow path 900 to the slave pump 10. This drives the diaphragm 13 to transmit the pressure to the coating liquid 31 (ejection fluid). In this way, the pressure is transmitted through the driving-side flow path 900. Thus, even if the driving-side flow path 900 is long, the pressure is still transmitted efficiently to the slave pump 10. This prevents severe limitation on a distance between the slave pump 10 and the master pump 50 connected through the driving-side flow path 900.

Thus, the driving device of this embodiment achieves a high degree of freedom in terms of arrangement of the slave pump 10 and the master pump 50. If the coating liquid 31 (ejection fluid) is a liquid that dislikes contact with the atmosphere (such as a liquid to be deteriorated by the contact with the atmosphere), for example, the slave pump 10 can be arranged to be separated from the atmosphere while the master pump 50 is arranged in the atmosphere.

In the configuration of this embodiment in which pressure is transmitted through the water 41 (driving fluid), the capacity of the ejection chamber 12 in the slave pump 10 is smaller than that of the ejection chamber 52 in the master pump 50. This allows transmission of high pressure to the slave pump 10 even in the case of a small change in the capacity of the ejection chamber 52 in the master pump 50, thereby reducing burden on the master pump 50.

Further, in the coating device of this embodiment, the slave pump 10 is driven with the water 41 (driving fluid). This eliminates the need to provide an electrical structure such as a motor to the slave pump 10. Meanwhile, the master pump 50 can be a pump to be driven by an electrical structure (in this embodiment, the motor 51). Specifically, the configuration of the coating device can be such that a pump requiring an electrical structure (such as a motor) is used as the driving-side pump, and a pump different from the former pump and not requiring an electrical structure is used as the ejection-side pump.

Further, in the coating device of this embodiment, the water 41 is used as a fluid for filling the driving-side flow path 900. This allows reduction in cost of running the coating device to achieve economic effect. The water 41 as the driving fluid is an incompressible liquid. Thus, pressure applied from the master pump 50 to the water is transmitted to the slave pump 10 without being lost during the transmission (specifically, without being absorbed by the water 41).

[1-2] Modifications

(1) First Modification

The foregoing coating device may have a configuration in which the slave pump 10 is attachable and detachable and in which the master pump 50 is directly connectable to the slit nozzle 20. In this configuration, in the case of a large amount of ejection, the coating liquid 31 can be ejected from the slit nozzle 20 using only the master pump 50. In this way, a pump to be used for ejection is appropriately changeable in response to an intended amount of ejection. Specifically, a selection can be made between use of only the master pump 50 and use of both the master pump 50 and the slave pump 10.

(2) Second Modification

Figure 2B:
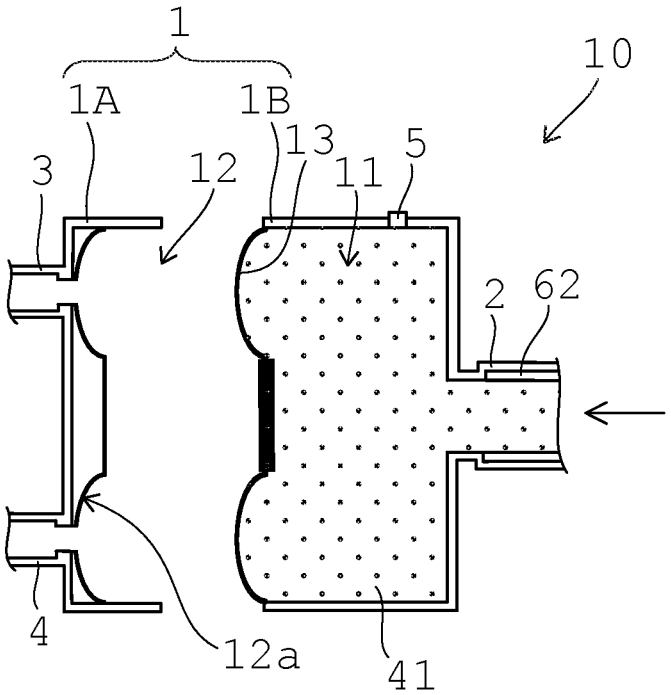
FIG. 2B is an exploded view of the slave pump.

As shown in FIG. 2B, in the slave pump 10, the case 1 may be made up of a body part 1B forming the driving chamber 11 and a cover part 1A forming the ejection chamber 12, and the cover part 1A may be attached to the body part 1B so as to be detachable from the body part 1B. In this configuration, the diaphragm 13 is preferably attached to the body part 1B to hermetically close the driving-side flow path 900. In this slave pump 10, for the purpose such as cleaning of the interior of the ejection chamber 12, the interior of the ejection chamber 12 can easily be exposed by detaching the cover part 1A from the body part 1B. Even if the interior of the ejection chamber 12 is exposed, the driving-side flow path 900 is still kept in a hermetically-closed condition by the diaphragm 13. This fulfills the purpose such as cleaning of the interior of the ejection chamber 12 while the driving-side flow path 900 including the driving chamber 11 is kept filled with the water 41.

(3) Third Modification

The driving fluid (a fluid to which pressure is applied from the master pump 50 and through which the pressure is transmitted) for filling the driving-side flow path 900 is not limited to the water 41 but various types of incompressible liquids are applicable as the driving fluid. The driving fluid may also be a compressible liquid. In this case, a pressure gauge is preferably attached to the connection tube 62 forming the driving-side flow path 900 and the operation of the master pump 50 is preferably controlled based on measured pressure. By doing so, intended pressure can be applied to the fluid (driving fluid) in the driving-side flow path 900.

The driving fluid may be a fluid not to contaminate the coating liquid 31 even if being mixed with the coating liquid 31. In this case, even if the driving fluid leaks from the driving chamber 11 into the ejection chamber 12 in the slave pump 10, the coating liquid 31 can still be kept in an available condition.

(4) Fourth Modification

A nozzle that ejects the coating liquid 31 is not limited to the slit nozzle 20 but various types of ejection nozzles are applicable instead of the slit nozzle 20. A substance to be ejected from the nozzle is not limited to a liquid such as the coating liquid 31 but various types of fluids containing powder are applicable as the substance. Specifically, various types of fluids containing liquid and powder are applicable as the ejection fluid.

(5) Fifth Modification

Figure 3:
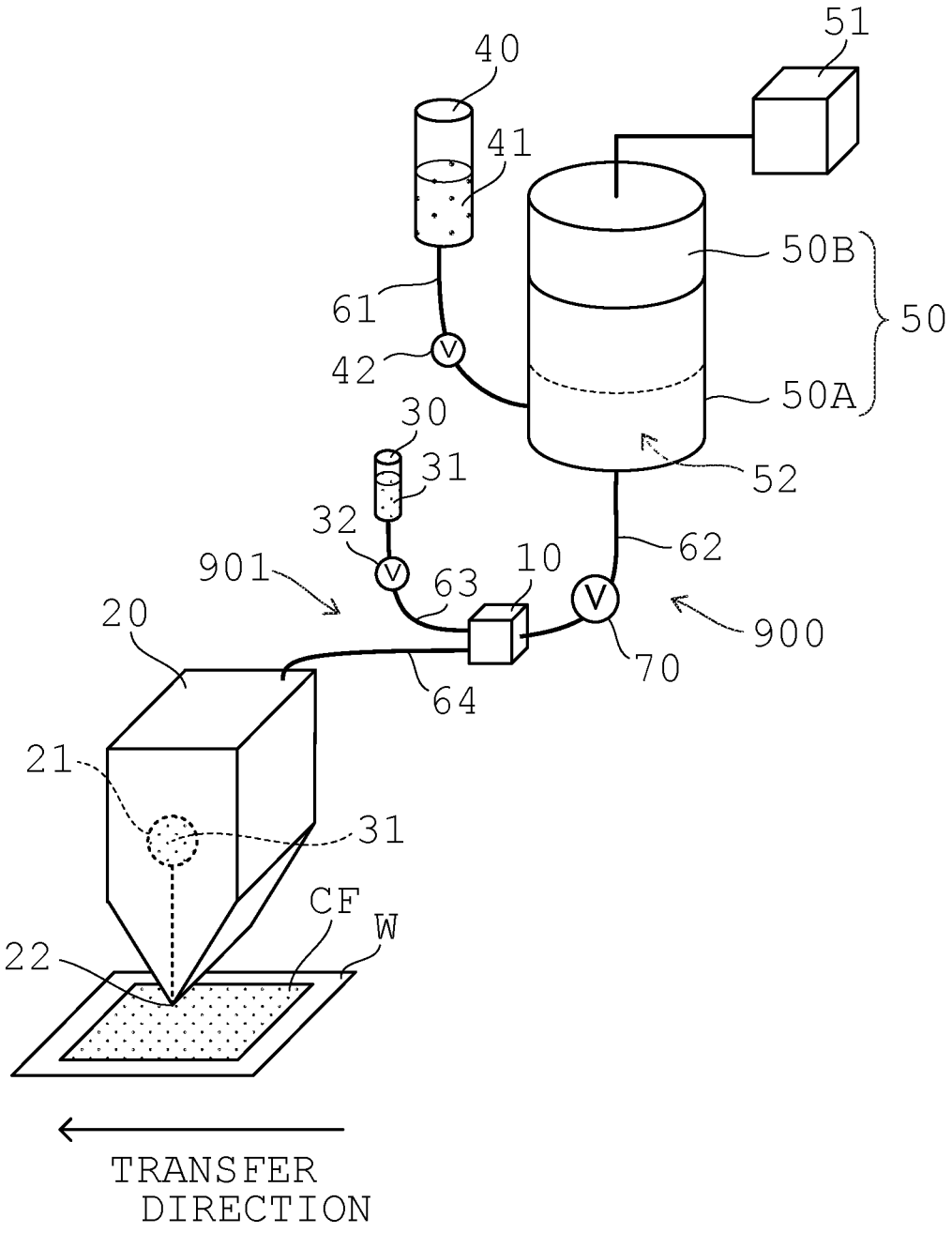
FIG. 3 is a conceptual view showing a modification of the coating device according to the first embodiment.

The speed of displacement of the diaphragm 13 changes in response to the flow rate of the water 41 (driving fluid) in the driving-side flow path 900. In this regard, as shown in FIG. 3, the coating device may further include a flow rate control valve 70 that controls the flow rate of the water 41 (driving fluid) in the driving-side flow path 900. In this modification, the flow rate control valve 70 is provided in the connection tube 62. The flow rate of the water 41 in the driving-side flow path 900 is controlled using the flow rate control valve 70, thereby controlling the speed of displacement of the diaphragm 13. This makes it possible to eject the coating liquid 31 from the slit 22 at a constantly maintained amount per unit time.

[2] Second Embodiment

Figure 4:
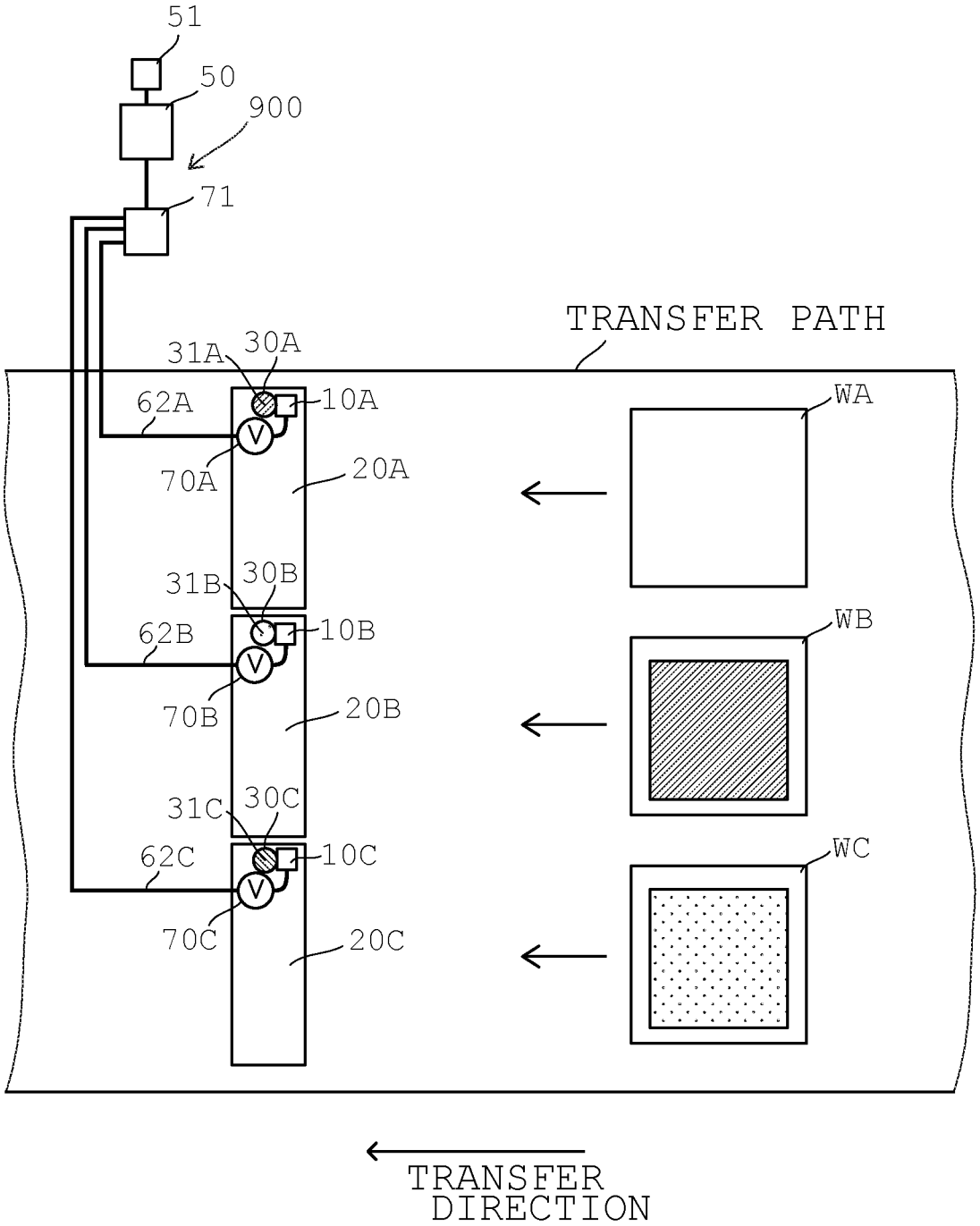
FIG. 4 is a conceptual view of a coating device according to a second embodiment.

In a second embodiment, the coating device may include a plurality of sets each made up of the slit nozzle 20, the slave pump 10, and the storage tank 30. Referring to FIG. 4 showing an example of the second embodiment, the coating device includes three slit nozzles 20A to 20C, three slave pumps 10A to 10C, and three storage tanks 30A to 30C. Each of the slave pumps 10A to 10C is prepared for a corresponding one of the slit nozzles 20A to 20C. Each of the storage tanks 30A to 30C is also prepared for a corresponding one of the slit nozzles 20A to 20C.

The storage tank 30A stores a coating liquid 31A (conductive ink containing gold, for example) to be supplied to the slave pump 10A. The storage tank 30B stores a coating liquid 31B (conductive ink containing platinum, for example) to be supplied to the slave pump 10B. The storage tank 30C stores a coating liquid 31C (resist liquid, for example) to be supplied to the slave pump 10C.

In this configuration, the coating device preferably includes a flow path branching valve 71 connecting each of the slave pumps 10A to 10C to the master pump 50. More specifically, the flow path branching valve 71 branches the driving-side flow path 900 from the master pump 50 into three, and connects the three branched flow paths to corresponding ones of the slave pumps 10A to 10C. In this embodiment, the flow path branching valve 71 is connected to the slave pumps 10A to 10C through three connection tubes 62A to 62C respectively. The connection tubes 62A to 62C are provided with three flow rate control valves 70A to 70C respectively like the foregoing flow rate control valve 70.

The coating device transfers three workpieces W in a transfer direction along a transfer path. When the workpieces W come to face corresponding ones of the slit nozzles 20A to 20C, the coating device ejects the coating liquids 31A to 31C from the slit nozzles 20A to 20C respectively. By doing so, respective coating films of the coating liquids 31A to 31C are formed on respective main surfaces of the workpieces W. In this way, the three workpieces W are simultaneously subjected to coating steps of forming the respective coating films of the coating liquids 31A to 31C on the three workpieces W.

After the coating steps on the corresponding workpieces W are finished, the workpieces W are carried sequentially to a direction (in FIG. 4, downward direction) vertical to the transfer direction and are placed at positions for next coating steps. In this way, each of the workpieces W is subjected to the foregoing three coating steps and drying steps between the coating steps performed sequentially. Specifically, a film made of the coating liquid 31A, a film made of the coating liquid 31B, and a film made of the coating liquid 31C are sequentially stacked on the main surface of each workpiece W.

Like the coating device of the first embodiment, the coating device of this embodiment achieves increase in the efficiency of use of each of the coating liquids 31A to 31C. Further, like in the first embodiment, severe limitation is not imposed on a distance between each of the slave pumps 10A to 10C and the master pump 50 connected through the driving-side flow path 900.

Further, in the coating device of this embodiment, the respective flow rates of the coating liquids 31A to 31C are controlled by the flow rate control valves 70A to 70C corresponding to the slit nozzles 20A to 20C respectively. This allows the three coating steps to be performed simultaneously, even if coating films of the coating liquids 31A to 31C are to be formed to different thicknesses.

The coating device of the second embodiment may have a configuration for performing one of the foregoing three coating steps selectively. As an example, the coating device may include a flow path switching valve instead of the flow path branching valve 71. The flow path switching valve connects at least one of the respective driving chambers 11 in the slave pumps 10A to 10C selectively to the master pump 50. This configuration of switching a flow path using the flow path switching valve makes it possible to easily select a coating liquid to be used for coating. Further, this configuration eliminates the need for troublesome work such as cleaning of a slave pump or exchange of a coating liquid to be done each time the coating liquid is changed.

[3] Third Embodiment

Figure 5:
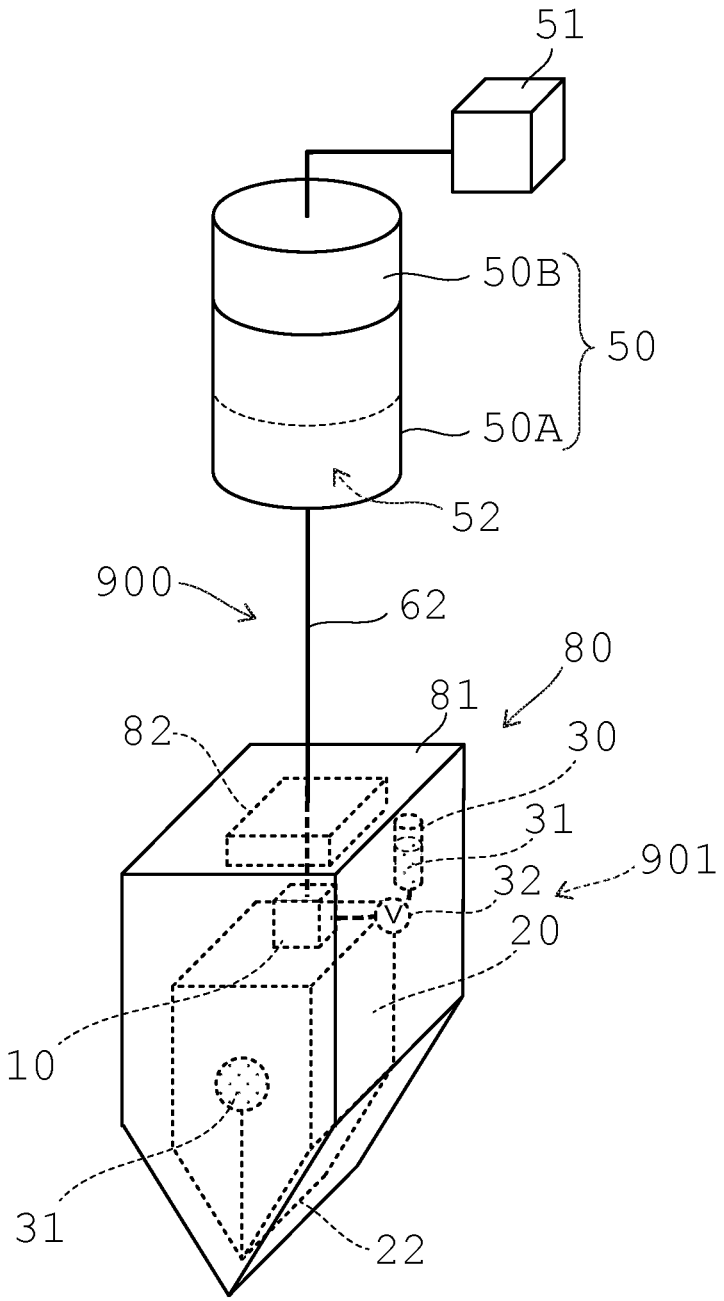
FIG. 5 is a conceptual view of a coating device according to a third embodiment.

The foregoing coating devices preferably include a heating unit that heats at least the slave pump 10 while the master pump 50 remains unheated. As shown in FIG. 5, a heating unit 80 of a third embodiment includes a case 81 and a heater 82 that heats the interior of the case 81. The case 81 houses the heater 82, the slave pump 10, the slit nozzle 20, the storage tank 30, and a connection tube connecting these elements. The slit nozzle 20 is housed while the tip (slit 22) from which the coating liquid 31 is to be ejected is exposed from the case 81. Each element housed in the case 81 is heated by the heater 82, so that it preferably has heat resistance so as not to deteriorate or damage its function. To prevent escape of heat from the heater 82 to the outside of the case 81, the periphery of the case 81 is preferably covered with a heat insulator.

As described above, in the configuration of the coating device of this embodiment, a pump requiring an electrical structure (such as a motor) is used as the driving-side pump (master pump 50), and a pump different from the former pump and not requiring an electrical structure is used as the ejection-side pump (slave pump 10). As a result of this configuration, the foregoing heating unit 80 as a structure for efficiently heating the coating liquid 31 (ejection fluid) becomes applicable to the coating device. Specifically, the ejection-side flow path 901 including the slave pump 10 can be heated as a whole while the master pump 50 remains unheated.

Thus, the coating device of this embodiment is capable of minimizing an effort for providing heat resistance to the master pump 50. For example, it becomes unnecessary to cover the motor 51 as a source of driving the master pump 50 with a material such as heat shield or the need for a material such as a heat shield can be minimized. Additionally, it becomes unnecessary to incorporate a heat-resisting component into a structure of the master pump 50 or provide the master pump 50 itself with a cooling mechanism. In this way, cost increase and complexity can be prevented in the coating device.

The slave pump 10 has a simple configuration with the driving chamber 11 and the ejection chamber 12 formed by partitioning the interior of the case 1 using the diaphragm 13, so that the slave pump 10 does not require an electrical structure such as a motor. Thus, the slave pump 10 can easily be given heat resistance. For example, the slave pump can be given resistance to heat up to a temperature of several hundreds of degrees C. by using a heat-resisting material such as stainless steel for forming the case 1 and the diaphragm 13.

Thus, the coating device of this embodiment allows heating of the coating liquid 31 using the heating unit 80 and provision of heat resistance to the pumps (master pump 50 and slave pump 10) with a minimum required effort.

In the coating device of this embodiment, the driving-side flow path 900 as a whole is preferably arranged outside the case 81. This configuration makes it possible to further reduce influence of heat on the master pump 50. The driving-side flow path 900 is preferably filled with a liquid (oil, for example) having a boiling point equal to or higher than that of the coating liquid 31 instead of the water 41. In this case, the liquid in the driving-side flow path 900 can be prevented from boiling. This prevents pressure in the driving-side flow path 900 from being increased unintentionally by the heating of the coating liquid 31.

In the third embodiment, the coating device may have a configuration in which the capacity of the ejection chamber 12 in the slave pump 10 is larger than that of the ejection chamber 52 in the master pump 50 or a configuration in which these ejection chambers have the same capacity. Even if in these configuration, like in the foregoing configuration, heat resistance can be provided to the master pump 50 and the slave pump 10 with a minimum required effort.

Figure 6:
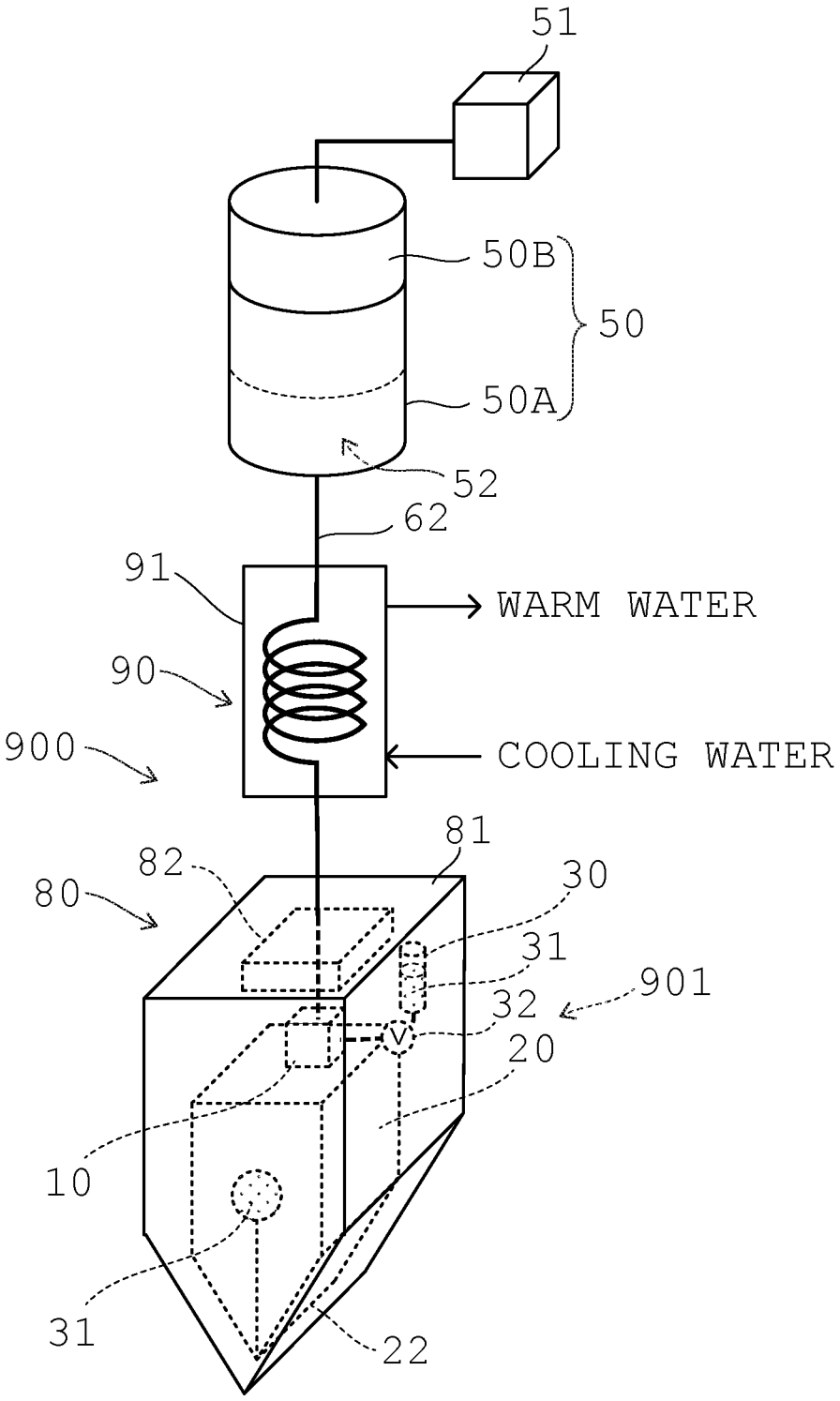
FIG. 6 is a conceptual view showing a modification of the coating device according to the third embodiment.

As shown in FIG. 6, the coating device of this embodiment may have a cooling unit 90 that cools the driving-side flow path 900. As an example, the cooling unit 90 includes a heat exchanger 91 provided in the connection tube 62, and the heat exchanger 91 draws heat from the connection tube 62. More specifically, cooling water flows into the heat exchanger 91. The water is heated with heat drawn from the connection tube 62 and flows out from the heat exchanger 91 as warm water. In the heat exchanger 91, the connection tube 62 is preferably wound into a spiral pattern so as to ensure a large area of contact with the heat exchanger 91.

In the coating device with the cooling unit 90, the connection tube 62 is cooled by the cooling unit 90. This can prevent the master pump 50 from being affected adversely with the heat of the heating unit 80 transmitted to the master pump 50 through the connection tube 62. Thus, the need for making an effort for providing heat resistance to the master pump 50 can be reduced further in the coating device.

Fourth Embodiment

Figure 7:
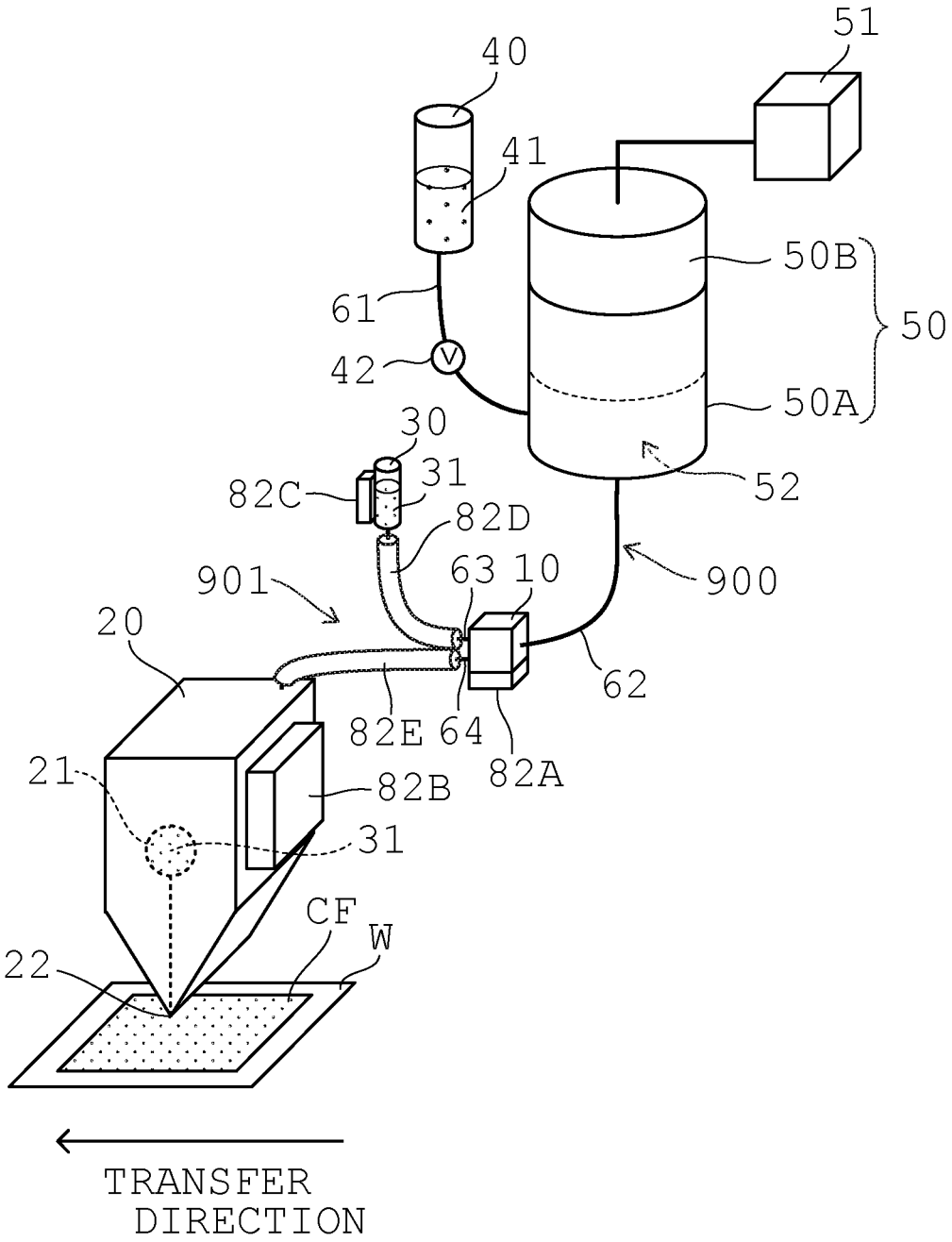
FIG. 7 is a conceptual view of a coating device according to a fourth embodiment.

As shown in FIG. 7, in a fourth embodiment, the heating unit 80 including the case 81 and the heater 82 may be replaced by a heating unit including heaters 82A to 82E that respectively heat the slave pump 10, the slit nozzle 20, the storage tank 30, the connection tube 63, and the connection tube 64 individually.

Like in the coating device of the third embodiment, in the configuration of a coating device of this embodiment, a pump requiring an electrical structure (such as a motor) is used as the driving-side pump (master pump 50), and a pump different from the former pump and not requiring an electrical structure is used as the ejection-side pump (slave pump 10). As a result of this configuration, the heating unit 80 with the heaters 82A to 82E becomes applicable to the coating device. Specifically, the ejection-side flow path 901 including the slave pump 10 can be heated as a whole while the master pump 50 remains unheated.

In the coating device of this embodiment, the temperatures of the heaters 82A to 82E are controlled individually. Thus, the coating liquid 31 in the ejection-side flow path 901 can efficiently be heated to a temperature appropriate for each position. Thus, the coating liquid 31 in a condition suitable for coating can be ejected from the slit nozzle 20.

Thus, the coating device of this embodiment allows efficient heating of the coating liquid 31 using the heating unit 80 and provision of heat resistance to the pumps (master pump 50 and slave pump 10) with a minimum required effort.

In this embodiment, mainly heating the slave pump 10 is important. The reason for this is that the capacity of the ejection chamber 12 in the slave pump 10 has a highest ratio to the capacity of the ejection-side flow path 901 as a whole, so that much of the coating liquid 31 in the ejection-side flow path 901 is heated by heating the slave pump 10, which leads to efficient heating of the coating liquid 31. Thus, the heating unit 80 of this embodiment may have a configuration with only the heater 82A for heating the slave pump 10, or a configuration with only some of the heaters 82A to 82E including the heater 82A.

Each structure of the third embodiment and that of the fourth embodiment are applicable to the coating device of the second embodiment. For this application, all the slave pumps 10A to 10C may be heated individually, or one or some of these slave pumps may be heated.

The above explanations of the embodiments are nothing more than illustrative in any respect, nor should be thought of as restrictive. The scope of the present invention is indicated by claims rather than the foregoing embodiments. Further, all changes that are equivalent to claims in the sense and realm of the doctrine of equivalence are intended to be included within the scope of the present invention.

REFERENCE SIGNS LIST

1 Case
1A Cover part
1B Body part
2, 3, 4 Connection port
5 Air outlet
10, 10A, 10B, 10C Slave pump
11 Driving chamber
12 Ejection chamber
12*a* Inner surface
13 Diaphragm
20, 20A, 20B, 20C Slit nozzle
21 Storage part
22 Slit
30, 30A, 30B, 30C Storage tank
31, 31A, 31B, 31C Coating liquid
32 Air-actuated valve
40 Storage tank
41 Water
42 Air-actuated valve
50 Master pump
50A Syringe
50B Plunger
51 Motor
52 Ejection chamber
61, 62, 63, 64 Connection tube
62A, 62B, 62C Connection tube
70, 70A, 70B, 70C Flow rate control valve
71 Flow path branching valve
80 Heating unit
81 Case
82, 82A, 82B, 82C Heater
90 Cooling unit
91 Heat exchanger
900 Driving-side flow path
901 Ejection-side flow path
CF Coating film
W Workpiece

The invention claimed is:

1. An ejection device comprising:
a nozzle that ejects an ejection fluid;
an ejection-side pump including a pressure transmitting member, a first ejection chamber, and a driving chamber adjacent to the first ejection chamber across the pressure transmitting member; and
a driving-side pump including a second ejection chamber,
wherein the election device is configured to operate with the ejection-side pump in an attached position and in a detached position,
in the attached position:
the first ejection chamber is connected to the nozzle and filled with the ejection fluid;
a driving-side flow path leads from the second ejection chamber of the driving-side pump to the driving chamber of the ejection-side pump;
the driving chamber, the driving-side flow path, and the second ejection chamber are filled with a driving fluid;
by application of pressure from the driving-side pump to the driving fluid in the second ejection chamber, the pressure is transmitted through the driving fluid to the ejection-side pump; and
the ejection-side pump transmits the pressure having been transmitted through the driving fluid further to the ejection fluid in the first ejection chamber through the pressure transmitting member, thereby ejecting the ejection fluid from the nozzle, and
in the detached position:
the nozzle is connected to the second ejection chamber;
the second ejection chamber is filled with the ejection fluid; and
by application of pressure from the driving-side pump to the ejection fluid in the second ejection chamber, the ejection fluid is ejected from the nozzle.

2. The ejection device according to claim 1, wherein
the first ejection chamber in the ejection-side pump has a smaller volume than the second ejection chamber in the driving-side pump in the attached position.

3. The ejection device according to claim 1, wherein
the pressure transmitting member is a diaphragm separating the driving chamber and the first ejection chamber from each other in the ejection-side pump in the attached position.

4. The ejection device according to claim 1, wherein
in the attached position, the ejection-side pump includes a case, and the interior of the case is partitioned by the pressure transmitting member to form the driving chamber and the first ejection chamber, and
the case includes a body part forming the driving chamber and a cover part forming the first ejection chamber, the cover part is attachable to and detachable from the body part, and the pressure transmitting member is attached to the body part.

5. The ejection device according to claim 1, further comprising:
a plurality of sets each including the nozzle and the ejection-side pump, and
a flow path switching part that connects at least one of the driving chambers in the ejection-side pumps selectively to the driving-side pump in the attached position.

6. The ejection device according to claim 1, further comprising:
a heating unit that heats at least the ejection-side pump while the driving-side pump remains unheated in the attached position.

7. The ejection device according to claim 6, further comprising:
a storage part storing the ejection fluid; and
a connection member connecting the storage part and the nozzle while passing through the first ejection chamber, wherein
the storage part and the connection member are attachable and detachable with the ejection-side pump, and in the attached position, the heating unit further heats at least one of the storage part and the connection member.

8. The ejection device according to claim 6, wherein
the heating unit further heats the nozzle in the attached position.

9. The ejection device according to claim 6, wherein
the heating unit includes:
a case housing the nozzle while a tip of the nozzle from which the ejection fluid is to be ejected is exposed from the case; and
a heater that heats the interior of the case, and
the case further houses the ejection-side pump in the attached position.

10. The ejection device according to claim 6, further comprising a cooling unit that cools the driving-side flow path in the attached position.

11. The ejection device according to claim 1, further comprising a heating unit that heats the nozzle.

12. The ejection device according to claim 11, further comprising a cooling unit that cools the driving-side flow path in the attached position.

13. The ejection device according to claim 1, further comprising a flow rate control valve that controls the flow rate of the driving fluid in the driving-side flow path in the attached position.

14. The ejection device according to claim 1, wherein the ejection fluid is a liquid, and the driving fluid is a liquid having a boiling point equal to or higher than that of the ejection fluid in the attached position.

15. The ejection device according to claim 1, wherein the driving fluid is an incompressible fluid in the attached position.

* * * * *